US011754949B2

(12) United States Patent
Muramatsu

(10) Patent No.: US 11,754,949 B2
(45) Date of Patent: Sep. 12, 2023

(54) IMAGING SYSTEM WITH A DEVELOPING CHAMBER HAVING A DEVELOPER ROLLER AND MULTIPLE AIR PASSAGES

(71) Applicant: HEWLETT-PACKARD DEVELOPMENT COMPANY, L.P., Spring, TX (US)

(72) Inventor: Satoshi Muramatsu, Kanagawa (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/778,471

(22) PCT Filed: Oct. 19, 2020

(86) PCT No.: PCT/US2020/056290
§ 371 (c)(1),
(2) Date: May 20, 2022

(87) PCT Pub. No.: WO2021/108041
PCT Pub. Date: Jun. 3, 2021

(65) Prior Publication Data

US 2022/0413417 A1 Dec. 29, 2022

(30) Foreign Application Priority Data

Nov. 28, 2019 (JP) ..... 2019-215329

(51) Int. Cl.
*G03G 15/08* (2006.01)
*G03G 15/09* (2006.01)
*G03G 21/20* (2006.01)

(52) U.S. Cl.
CPC ..... *G03G 15/0891* (2013.01); *G03G 15/0889* (2013.01); *G03G 15/0893* (2013.01);
(Continued)

(58) Field of Classification Search
CPC ..... G03G 15/0891; G03G 15/0889; G03G 15/0898; G03G 2215/085; G03G 15/0887;
(Continued)

(56) References Cited

U.S. PATENT DOCUMENTS 5,953,563 A * 9/1999 Yamaguchi ..... G03G 15/09 399/119
8,036,576 B2 10/2011 Katoh et al.
(Continued)

FOREIGN PATENT DOCUMENTS

JP 2001100524 A * 4/2001
JP 2004-252193 A 9/2004
(Continued)

*Primary Examiner* — Arlene Heredia
*Assistant Examiner* — Laura Roth
(74) *Attorney, Agent, or Firm* — Foley & Lardner LLP

(57) ABSTRACT

An imaging system includes a developing chamber, a first conveyance path, a second conveyance path, a first air passage and a second air passage. A developing roller located in the developing chamber carries a developer to a developing region where the developing roller is closest to an image carrier. A first stirring-conveying portion is located in the first conveyance path adjacent the developing roller to supply the developer to the developing roller. A second stirring-conveying portion is located in the second conveyance path adjacent the first conveyance path to circulate the developer between the second conveyance path and the first conveyance path. The first air passage has an inlet coupled to the developing chamber and an outlet coupled to the second conveyance path, and the second air passage has an inlet coupled to the second conveyance path and an outlet coupled to the developing chamber.

15 Claims, 9 Drawing Sheets

(52) U.S. Cl.
CPC ..... *G03G 15/0898* (2013.01); *G03G 15/0921* (2013.01); *G03G 21/206* (2013.01); *G03G 15/0896* (2013.01); *G03G 2215/085* (2013.01); *G03G 2215/0838* (2013.01); *G03G 2221/1645* (2013.01)

(58) Field of Classification Search
CPC ..... G03G 15/0893; G03G 15/0896; G03G 15/0813; G03G 15/09; G03G 15/0921; G03G 21/206; G03G 2221/1645; G03G 2215/0838
See application file for complete search history.

(56) References Cited

U.S. PATENT DOCUMENTS

| | | | | |
|---|---|---|---|---|
| 8,112,016 | B2 | 2/2012 | Matsumoto et al. | |
| 8,774,683 | B2 | 7/2014 | Kubota et al. | |
| 9,244,376 | B2 | 1/2016 | Kuramoto et al. | |
| 10,877,400 | B1 * | 12/2020 | Kuramoto | G03G 21/206 |
| 2004/0223779 | A1 * | 11/2004 | Satoh | G03G 15/0942 399/98 |
| 2005/0084280 | A1 * | 4/2005 | Hunter | G03G 15/0887 399/253 |
| 2006/0239710 | A1 * | 10/2006 | Kumar | G03G 15/0898 399/103 |
| 2007/0292163 | A1 * | 12/2007 | Zirilli | G03G 15/0898 399/253 |
| 2010/0150615 | A1 * | 6/2010 | Nakagawa | G03G 15/0808 399/265 |
| 2015/0010323 | A1 * | 1/2015 | Okuma | G03G 15/0942 399/104 |
| 2015/0110518 | A1 * | 4/2015 | Nagamori | G03G 21/206 399/92 |
| 2018/0136586 | A1 * | 5/2018 | Tsuchiya | G03G 15/0881 |
| 2021/0278783 | A1 * | 9/2021 | Kato | G03G 15/104 |
| 2021/0373456 | A1 * | 12/2021 | Iwata | G03G 15/0898 |
| 2022/0121139 | A1 * | 4/2022 | Kato | G03G 15/0865 |
| 2022/0197181 | A1 * | 6/2022 | Iwata | G03G 15/0921 |
| 2022/0308498 | A1 * | 9/2022 | Hoshino | G03G 15/0889 |

FOREIGN PATENT DOCUMENTS

| | | | |
|---|---|---|---|
| JP | 2005-92022 | A | 4/2005 |
| JP | 2005-258275 | A | 9/2005 |
| JP | 2007-178905 | A | 7/2007 |
| JP | 5168115 | B2 | 3/2013 |
| WO | WO-2021061334 | A1 * | 4/2021 |

* cited by examiner

IMAGING SYSTEM WITH A DEVELOPING CHAMBER HAVING A DEVELOPER ROLLER AND MULTIPLE AIR PASSAGES

BACKGROUND

Some imaging apparatuses include a flow passage forming member that is elongated (e.g., extends longitudinally) in a rotation direction of a developing roller between the developing roller and an inner wall of a developing device body in order to suppress an increase in air pressure inside the developing device body and to inhibit toner from scattering to the outside of the developing device body.

DETAILED DESCRIPTION

In the following description, with reference to the drawings, the same reference numbers are assigned to the same components or to similar components having the same function, and overlapping description is omitted. Hereinafter, an example imaging system will be described. The imaging system may be an imaging apparatus such as a printer, according to some examples, or a developing device used in the imaging apparatus or the like, according to other examples.

Figure 1:
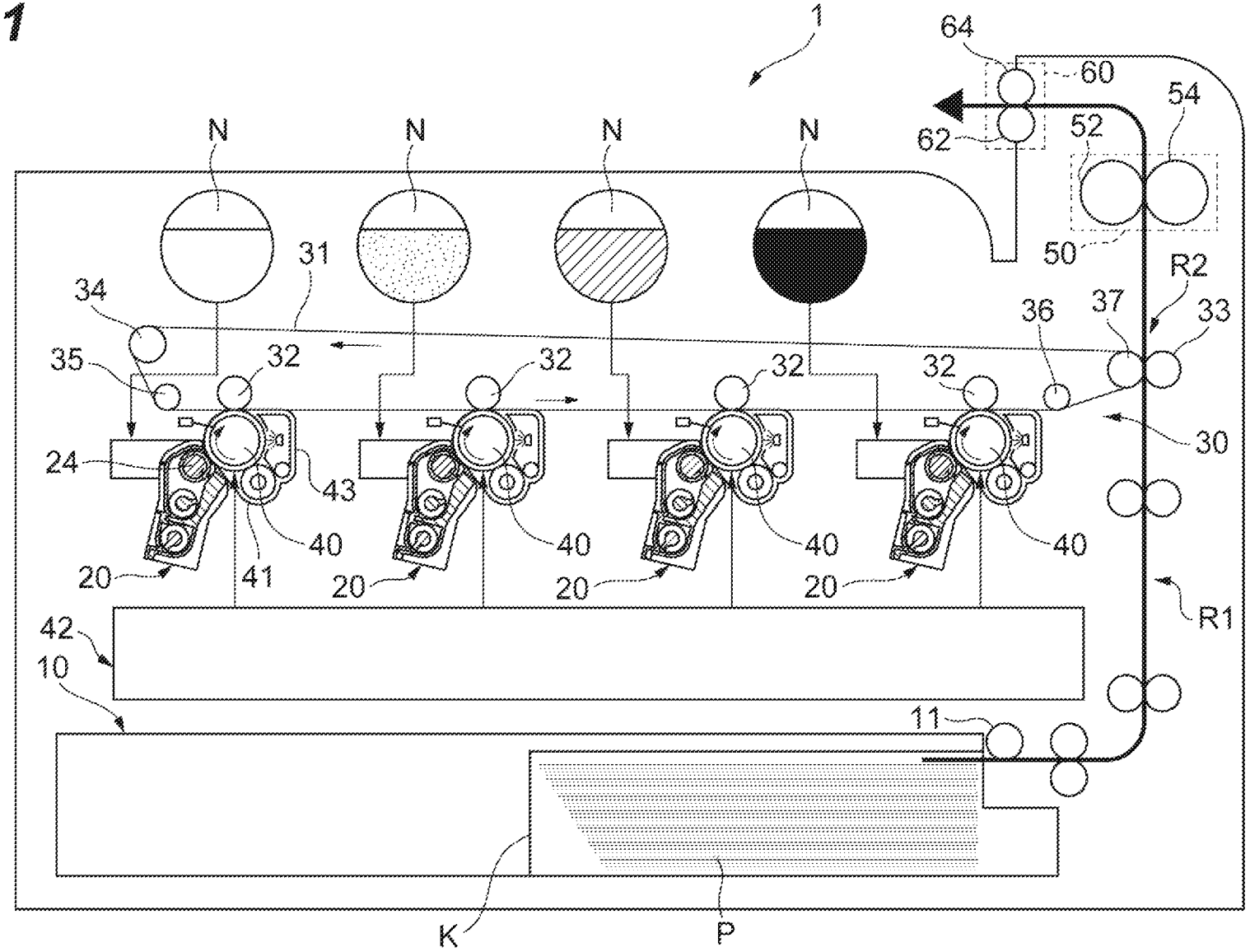
FIG. 1 is a schematic diagram of an example imaging apparatus.

With reference to FIG. 1, an example imaging apparatus 1 may form a color image by using four colors of magenta, yellow, cyan, and black. The imaging apparatus 1 may include a conveying device 10 which conveys a sheet P corresponding to a recording medium, a developing device 20 which develops an electrostatic latent image, a transfer device 30 which secondarily transfers a toner image onto the sheet P, an image carrier 40 which forms an electrostatic latent image on a surface (a peripheral surface) thereof, a fixing device 50 which fixes a toner image onto the sheet P, and a discharging device 60 which discharges the sheet P.

The conveying device 10 conveys the sheet P which is a recording medium on which an image is to be formed, along a conveyance route R1. The sheet P is accommodated in a cassette K in a stacked state and is picked up and conveyed by a feeding roller 11. The conveying device 10 allows the sheet P to reach a transfer nip region R2 through the conveyance route R1 at a timing at which the toner image to be transferred onto the sheet P reaches the transfer nip region R2.

Four developing devices 20 are provided so as to correspond respectively to the four colors of magenta, yellow, cyan, and black. Each developing device 20 includes a developing roller 24 which carries a toner on the image carrier 40. In the developing device 20, a two-component developer containing a toner and a carrier is used as the developer. For example, in the developing device 20, the toner and the carrier may be adjusted to a selected mixing ratio and are further mixed and stirred so as to uniformly disperse the toner, so that the developer is adjusted to have an optimal or targeted charge amount. The developer is carried on the developing roller 24. When the developer is conveyed to a developing region R4 (cf. FIG. 2) facing the image carrier 40 via a rotation of the developing roller 24, the toner of the developer carried on the developing roller 24 is transferred to the electrostatic latent image formed on the peripheral surface of the image carrier 40, so as to develop the electrostatic latent image.

The transfer device 30 conveys the toner image formed by the developing device 20 to the transfer nip region R2 where the toner image is secondarily transferred to the sheet P. The transfer device 30 includes a transfer belt 31 onto which the toner image is primarily transferred from the image carrier 40, suspension rollers 34, 35, 36, and 37 which suspend the transfer belt 31, a primary transfer roller 32 which sandwiches the transfer belt 31 along with the image carrier 40, and a secondary transfer roller 33 which sandwiches the transfer belt 31 along with the suspension roller 37.

The transfer belt 31 is an endless belt which moves in a circulating manner by the suspension rollers 34, 35, 36, and 37. Each of the suspension rollers 34, 35, 36, and 37 is rotatable about respective rotational axes. The suspension roller 37 is a drive roller which rotates around an axis in a driving manner and the suspension rollers 34, 35, and 36 are driven rollers which rotate in a driven manner in accordance with the rotation of the suspension roller 37. The primary transfer roller 32 is provided so as to press the image carrier 40 from the inner peripheral side of the transfer belt 31. The secondary transfer roller 33 extends parallel to the suspension roller 37 with the transfer belt 31 interposed between secondary transfer roller 33 and the suspension roller 37, so as to press against the suspension roller 37 from the outer peripheral side of the transfer belt 31. Accordingly, the secondary transfer roller 33 forms the transfer nip region R2 between the secondary transfer roller 33 and the transfer belt 31.

The image carrier 40 is also referred to as an electrostatic latent image carrier, a photosensitive drum, or the like. Four image carriers 40 are provided so as to correspond to the respective four colors. The image carriers 40 are provided along the movement direction of the transfer belt 31. The developing device 20, a charging roller 41, an exposure unit (or exposure device) 42, and a cleaning unit (or cleaning device) 43 are provided on the periphery of the image carrier 40.

The charging roller 41 uniformly charges the surface of the image carrier 40 to a predetermined or selected potential. The charging roller 41 moves in accordance with the rotation of the image carrier 40. The exposure unit 42 exposes the surface of the image carrier 40 having been charged, in accordance with the image to be formed on the sheet P. A potential of a portion exposed by the exposure unit 42 in the surface of the image carrier 40 changes, so that an electrostatic latent image is formed. Each of four developing devices 20 generates a toner image by developing the electrostatic latent image formed on the image carrier 40 with the toner supplied from the associated toner tank N that faces the developing device 20. The toner tanks N are respectively filled with magenta, yellow, cyan, and black toners, in addition to the carrier particles in corresponding amounts to achieve the selected toner charge amount. The cleaning unit 43 collects the toner remaining on the image carrier 40 after the toner image formed on the image carrier 40 is primarily transferred to the transfer belt 31.

The fixing device 50 directs the sheet P to pass through a fixing nip region for heating and pressing the sheet so that the toner image secondarily transferred from the transfer belt 31 to the sheet P is adhered and fixed to the sheet P. The fixing device 50 includes a heating roller 52 which heats the sheet P and a pressing roller 54 which rotates in a driving manner while pressing the heating roller 52. The heating roller 52 and the pressing roller 54 are formed in a cylindrical shape and the heating roller 52 has a heat source such as a halogen lamp therein. A fixing nip region is a contact region between the heating roller 52 and the pressing roller 54 to melt and fix the toner image to the sheet P when the sheet P passes through the fixing nip region.

The discharging device 60 includes discharging rollers 62 and 64 which discharge the sheet P having the toner image fixed thereto by the fixing device 50 to the outside of the apparatus.

An example printing process of the example imaging apparatus 1 will be described. When an image signal of a recording target image is input to the imaging apparatus 1, a control unit (or controller) of the imaging apparatus 1 causes the feeding roller 11 to rotate so that the sheet P stacked in the cassette K is picked up and conveyed. The surface of the image carrier 40 is uniformly charged to a predetermined or selected potential by the charging roller 41 (a charging operation). Then, the surface of the image carrier 40 is irradiated with a laser beam by the exposure unit 42 based on the image signal received so as to form an electrostatic latent image (an exposing operation).

In the developing device 20, the electrostatic latent image is developed so as to form a toner image (a developing operation). The toner image is primarily transferred from the image carrier 40 to the transfer belt 31 at a region of the image carrier 40 that faces the transfer belt 31 (a transferring operation). The toner images formed on the four image carriers 40 are sequentially layered on the transfer belt 31 so as to form a single composite toner image. Then, the composite toner image is secondarily transferred to the sheet P conveyed from the conveying device 10 at the transfer nip region R2 where the suspension roller 37 faces the secondary transfer roller 33.

The sheet P onto which the composite toner image has been secondarily transferred is conveyed to the fixing device 50. The fixing device 50 heats and presses the sheet P between the heating roller 52 and the pressing roller 54 when the sheet P passes through the fixing nip region so that the composite toner image is melted and fixed to the sheet P (a fixing operation). Then, the sheet P is discharged to the outside of the imaging apparatus 1 by the discharging rollers 62 and 64.

Figure 2:
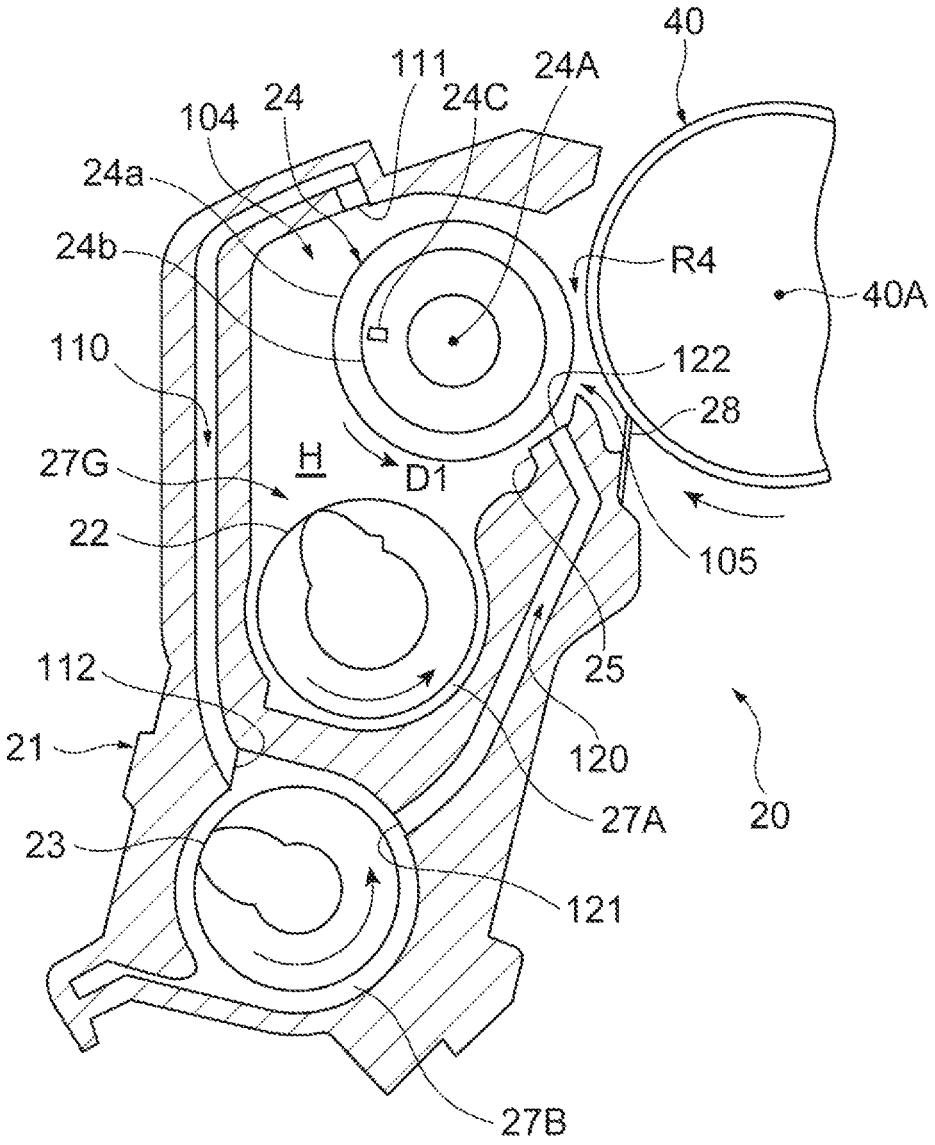
FIG. 2 is a schematic cross-sectional view illustrating an example developing device.

With reference to FIG. 2, an example developing device 20 is mounted on the imaging apparatus 1 illustrated in FIG. 1. The developing device 20 illustrated in FIG. 2 may include a rotatable image carrier 40, a housing 21, a first stirring conveying member 22, a second stirring conveying member 23, a rotatable developing roller 24, a developer regulator 25, a first air passage 110, and a second air passage 120.

An electrostatic latent image is formed on the surface of the image carrier 40. The image carrier 40 is rotatably supported by, for example, the housing 21 and is rotationally driven by a drive source such as a motor. The image carrier 40 may have a columnar shape.

The housing 21 forms a container of the developing device 20 and has a developing chamber H therein. The developing chamber H of the housing 21 receives a developer containing a toner and a carrier. Further, the developing roller 24 and the developer regulator 25 are accommodated in the developing chamber H of the housing 21. The housing 21 has an opening at a position where the developing roller 24 faces the image carrier 40 and the toner inside the developing chamber H is supplied from the opening to the image carrier 40. The housing 21 may include a filter which ventilates the inside and the outside of the developing chamber H and blocks the passage of the developer. The housing 21 may include a developer discharge port which discharges an old developer from the developing chamber H.

A seal 28 for suppressing a developer and a toner from scattering between the image carrier 40 and the housing 21 is attached to the housing 21. The seal 28 is disposed on the upstream side of the developing region R4 in a rotation direction (or rotational direction) D1 of the developing roller 24. The front end portion of the seal 28 is in contact with the image carrier 40. Accordingly, the seal 28 functions as a member that seals a gap between the developing roller 24 and the housing 21. The seal 28 is formed of, for example, a urethane resin having a thickness of 0.1 mm. The seal 28 may include an elastic member having a suitable sliding property to suppress or inhibit the image carrier 40 from being damaged and to achieve a sealing property between the developing roller 24 and the housing 21.

Figure 3:
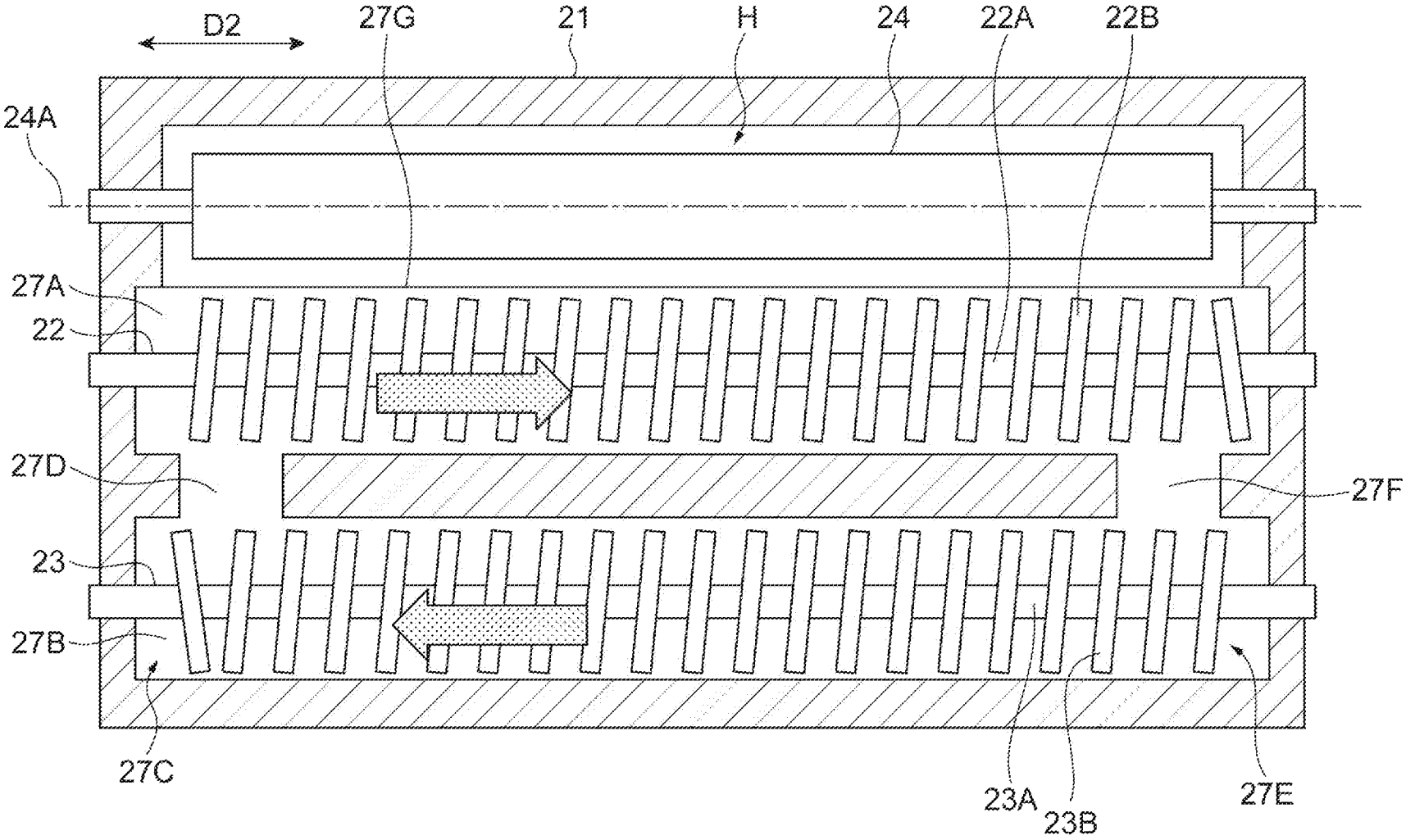
FIG. 3 is a schematic cross-sectional view illustrating a developing chamber, a first conveyance path, and a second conveyance path of the example developing device.

The developing roller 24 is disposed at a position facing the image carrier 40 so as to form a gap between the developing roller and the image carrier 40 and may rotate while carrying the developer received in the housing 21 on the surface thereof. For example, the developing roller 24 rotates in the rotation direction D1 so as to carry the developer. The developing roller 24 is formed in, for example, a columnar shape. As illustrated in FIGS. 2 and 3, the developing roller 24 includes a rotational axis 24A which extends in a longitudinal direction D2. The developing roller 24 is disposed so that the rotational axis 24A of the developing roller 24 is parallel to a rotational axis 40A of the image carrier 40, and so that a gap between the developing roller 24 and the image carrier 40 is substantially constant in the longitudinal direction (e.g., in the direction of the rotation axis 24A and the direction of the rotation axis 40A). The developing roller 24 carries the developer stirred by the first stirring conveying member 22 and the second stirring conveying member 23 on the surface thereof. The developing roller 24 conveys the developer carried thereon to the developing region R4 so as to develop the electrostatic latent image of the image carrier 40. The developing region R4 is a region located between the developing roller 24 and the image carrier 40 and is a region where the developing roller 24 faces the image carrier 40. The developing region R4 may be a region in which the developing roller 24 is closest to the image carrier 40.

The developing roller 24 includes a developing sleeve 24*a* which forms a surface layer of the developing roller 24 and a magnet 24*b* which is disposed inside the developing sleeve 24*a*. The developing sleeve 24*a* is a cylindrical member formed of non-magnetic metal. The developing sleeve 24*a* is rotatable around the rotation axis 24A. The magnet 24*b* is fixed to, for example, a shaft on the rotation axis 24A fixed to the housing 21 and has a plurality of magnetic poles. The developing sleeve 24*a* is rotatably supported by, for example, the shaft and is rotationally driven by a drive source such as a motor. The developer is carried on the surface of the developing sleeve 24*a* by the magnetic force of the magnet 24*b*. The developing roller 24 conveys the developer in the rotation direction of the developing sleeve 24*a* in accordance with the rotation of the developing sleeve 24*a*. Additionally, the rotation of the developing roller 24 means the rotation of the developing sleeve 24*a* and the rotation direction D1 of the developing roller 24 means the rotation direction of the developing sleeve 24*a*.

The developer forms a napping on the developing sleeve 24*a* in response to a magnetic force of each magnetic pole of the magnet 24*b*. The napping of the developer is also referred to as a magnetic brush. The developing roller 24 allows the napping of the developer formed by the magnetic pole to contact or approach (e.g, to come in proximity with) the electrostatic latent image of the image carrier 40 in the developing region R4. Accordingly, the toner in the developer carried on the developing roller 24 is transferred to the electrostatic latent image formed on the peripheral surface of the image carrier 40 so as to develop the electrostatic latent image.

Still with reference to FIG. 2, and with further reference to FIG. 3, the first stirring conveying member 22 and the second stirring conveying member 23 stirs a magnetic carrier and a non-magnetic toner constituting a developer so as to frictionally charge the carrier and the toner. Further, the first stirring conveying member 22 and the second stirring conveying member 23 convey the developer in a stirred state. The first stirring conveying member 22 is disposed in a first conveyance path 27A disposed below the developing chamber H and the second stirring conveying member 23 is disposed in a second conveyance path 27B disposed below the first conveyance path 27A. Accordingly, the first conveyance path 27A and the second conveyance path 27B are arranged at upper and lower positions, respectively. The first conveyance path 27A and the second conveyance path 27B extend in a direction parallel to the rotation axis 24A of the developing roller 24 and are disposed so as to be adjacent to one another. A first end portion 27C of the second conveyance path 27B is provided with a first opening 27D coupled (e.g., fluidly coupled) to the first conveyance path 27A. A second end portion 27E opposite to the first end portion 27C of the second conveyance path 27B is provided with a second opening 27F coupled (e.g., fluidly coupled) to the first conveyance path 27A. That is, the first conveyance path 27A and the second conveyance path 27B are divided by a wall which forms part of the housing 21 and this wall includes the first opening 27D and the second opening 27F.

The first conveyance path 27A is provided with an opening 27G coupled (e.g., fluidly coupled) to the developing chamber H. The opening 27G is an opening which opens the first conveyance path 27A to the developing chamber H. The first conveyance path 27A has a length extending in the longitudinal direction D2 and the opening 27G substantially extends along the entire length of the first conveyance path 27A. The developing roller 24 faces the first conveyance path 27A through the opening 27G.

The first stirring conveying member 22 is a supply auger for stirring the developer and supplying the developer to the developing roller. The first stirring conveying member 22 includes a rotation axis 22A and a spiral blade 22B which protrudes in a spiral shape from the rotation axis 22A. The first stirring conveying member 22 conveys the developer of the first conveyance path 27A from the first opening 27D toward the second opening 27F. The first stirring conveying member 22 may be rotationally driven by a drive device to rotate the spiral blade 22B about the rotation axis 22A, so that the spiral blade 22B conveys the developer from the first opening 27D toward the second opening 27F. Accordingly, the developer may be supplied to the developing roller 24 through the opening 27G and may be supplied from the first conveyance path 27A to the second conveyance path 27B through the second opening 27F.

The second stirring conveying member 23 is an add-mix auger for stirring the developer and circulating the developer between the first conveyance path 27A and the second conveyance path 27B. The second stirring conveying member 23 defines a rotation axis 23A and a spiral blade 23B which protrudes in a spiral shape about the rotation axis 23A. The second stirring conveying member 23 conveys the developer of the second conveyance path 27B from the second opening 27F toward the first opening 27D. The first opening 27D is disposed on the downstream side of the second opening 27F in the developer conveyance direction of the second conveyance path 27B. The second stirring conveying member 23 may be rotationally driven by a drive device to rotate the spiral blade 23B about the rotation axis 23A, so that the spiral blade 23B conveys the developer from the second opening 27F toward the first opening 27D. Accordingly, the developer may be supplied from the second conveyance path 27B to the first conveyance path 27A through the first opening 27D.

The developer regulator 25 regulates the thickness of the developer conveyed by the developing roller 24. For example, the developer regulator 25 may limit the carriage amount of the developer carried on the developing roller 24. The developer regulator 25 is disposed in the vicinity of the developing region R4 on the upstream side of the developing region R4 in the rotation direction D1 of the developing roller 24. The developer regulator 25 is spaced apart from the developing roller 24, such that a gap is formed between the developer regulator 25 and the developing roller 24. Consequently, the developer regulator 25 limits the layer thickness of the developer carried on the peripheral surface of the developing roller 24 with the rotation of the developing roller 24 so as to form a layer of developer, having a uniform layer thickness. The gap between the developer regulator 25 and the developing roller 24 may be adjusted to set the amount of the developer to be conveyed by the developing roller 24 to the developing region R4.

As illustrated in FIG. 2, the first air passage 110 and the second air passage 120 form a flow passage through which a gas flows. The first air passage 110 and the second air passage 120 may be formed by one or more hole(s) (air passage(s)) formed in the housing 21 according to some examples, by a member such as a duct or a cover attached to the housing 21 in other examples, or by both of one or more hole(s) (the air passage) formed in the housing 21 and a member such as a duct or a cover attached to the housing 21 according to yet other examples.

The first air passage 110 includes an inlet 111 which sucks or draws in an airflow, and an outlet 112 which discharges an airflow. The inlet 111 may be coupled (e.g., fluidly coupled) to the developing chamber H on the upstream side of the developer regulator 25, in the rotation direction D1 of the developing roller 24. The inlet 111 is formed by an opening of the first air passage 110 opening to (e.g., fluidly coupled to) the developing chamber H on the upstream side of the developer regulator 25, in the rotation direction D1 of the developing roller 24. In some examples, the inlet 111 is disposed on the upstream side, in the rotation direction D1 of the developing roller 24, of a pickoff pole 24*c* for detaching the developer carried on the developing roller 24 from the developing roller 24, among the plurality of magnetic poles of the developing roller 24.

The outlet 112 is coupled (e.g., fluidly coupled) to the second conveyance path 27B. The outlet 112 is formed by an opening of the first air passage 110 opening to (e.g., fluidly coupled to) the second conveyance path 27B.

The second air passage 120 includes an inlet 121 which sucks or draws in an airflow, and an outlet 122 which discharges an airflow. The inlet 121 is coupled (e.g., fluidly coupled) to the second conveyance path 27B. The inlet 121 is formed by an opening of the second air passage 120 opening to (e.g., fluidly coupled to) the second conveyance path 27B. The outlet 122 is coupled (e.g., fluidly coupled) to a region between the developer regulator 25 and the developing region R4. The outlet 122 is formed by an opening of the second air passage 120 opening to (e.g., fluidly coupled to) a region between the developer regulator 25 and the developing region R4. For example, the outlet 122 may be disposed in the developer regulator 25, between the developer regulator 25 and the housing 21, or in the housing 21.

Air that is present in a gap between the developing roller 24 and the image carrier 40, for example in the developing region R4, is pushed in the rotation direction D1 of the developing roller 24 due to the napping of the developer carried on the surface of the developing roller 24, that moves in accordance with the rotation of the developing sleeve 24*a* of the developing roller 24. Consequently, air is taken into the housing 21 on the downstream side of the developing region R4, in the rotation direction D1 of the developing roller 24. As a result, a positive pressure region 104 having an air pressure higher than the atmospheric pressure is formed in the developing chamber H on a side of the developing roller 24 that is opposite to the developing region R4. The positive pressure region 104 is, for example, a region adjacent the developing roller 24, that extends from the front end of the opening side of the housing 21 to the developer regulator 25 in the rotation direction D1 of the developing roller 24, for example, an upstream region of the developer regulator 25 in the rotation direction D1 of the developing roller 24. Meanwhile, air entering a gap formed between the developing roller 24 and the developer regulator 25 is limited by the developer regulator 25 on the upstream side of the developing region R4 in the rotation direction D1 of the developing roller 24. Further, a gap between the image carrier 40 and the housing 21 on the upstream side of the developing region R4 in the rotation direction D1 of the developing roller 24 is sealed by the seal 28. Consequently, a negative pressure region 105 having an air pressure lower than the atmospheric pressure is formed in a region adjacent to the developing region R4. The negative pressure region 105 is, for example, a region adjacent to the developing roller 24 on the upstream side of the developing region R4 in the rotation direction D1 of the developing roller 24. In some examples, the negative pressure region 105 may extend from the developer regulator 25 to the developing region R4 in the rotation direction D1 of the developing roller 24.

The inlet 111 of the first air passage 110 is coupled (e.g., fluidly coupled) to the developing chamber H in the positive pressure region 104 and the outlet 122 of the second air passage 120 is coupled (e.g., fluidly coupled) to the developing chamber H in the negative pressure region 105. Accordingly, a pressure difference is generated between the inlet 111 of the first air passage 110 and the outlet 122 of the second air passage 120. The first air passage 110 communicates with the second air passage 120 through the second conveyance path 27B. Since the air pressure in the second conveyance path 27B is less affected by the rotation of the developing roller 24 than the positive pressure region 104 and the negative pressure region 105, the air pressure in the second conveyance path 27B tends to be lower than the positive pressure region 104 and higher than the negative pressure region 105. The air pressure in the second conveyance path 27B may be equivalent to the atmospheric pressure, for example. Consequently, the air of the positive pressure region 104 is sucked or drawn from the inlet 111 of the first air passage 110 into the first air passage 110, the air drawn into the first air passage 110 is sucked or drawn in from the inlet 121 into the second air passage 120 via the second conveyance path 27B, and the air sucked or drawn in into the second air passage 120 is discharged from the outlet 122 of the second air passage 120 to the negative pressure region 105. Accordingly, an airflow which flows from the inlet 111 of the first air passage 110 toward the outlet 122 of the second air passage 120 is generated in the first air passage 110 and the second air passage 120.

Figure 4:
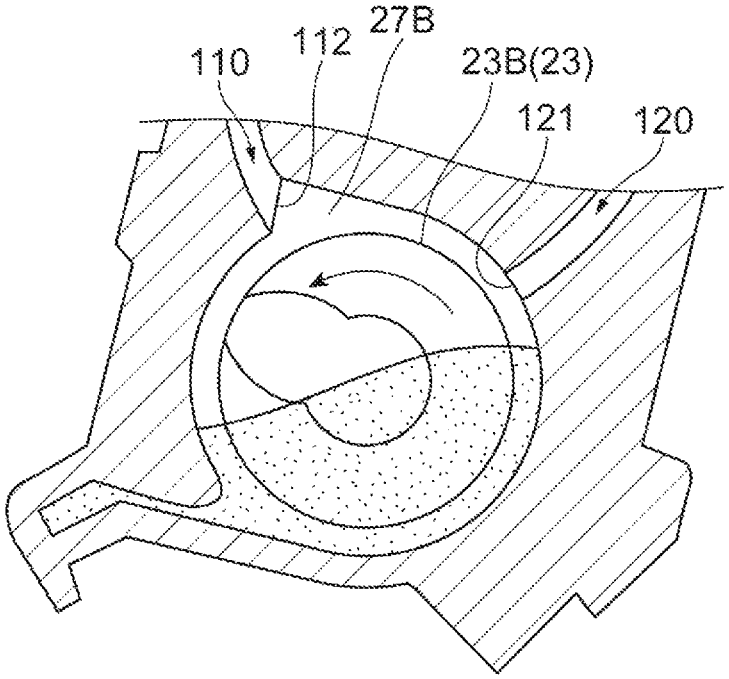
FIG. 4 is a schematic cross-sectional view of a portion of the example developing device illustrating an example state in which a second stirring conveying member is rotated.
Figure 5:
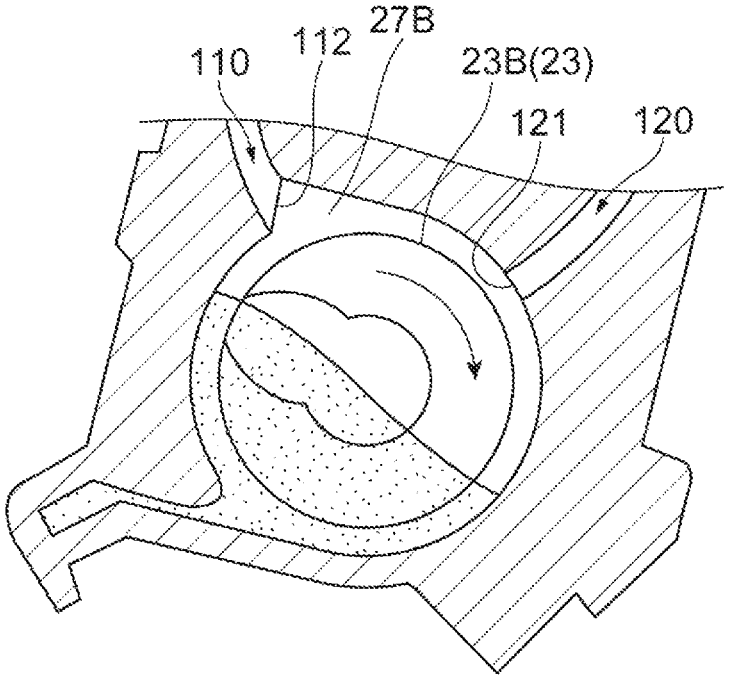
FIG. 5 is a schematic cross-sectional view of the portion of the example developing device, illustrating another example state in which the second stirring conveying member is rotated.

As illustrated in FIGS. 4 and 5, the developer supplied from the first conveyance path 27A is accumulated in the bottom portion of the second conveyance path 27B. Additionally, FIGS. 4 and 5 illustrate respective states in which the second stirring conveying member 23 rotates in a first direction (FIG. 4) and in a second direction (FIG. 5) that is opposite to the first direction. The outlet 112 of the first air passage 110 may be located at the upper portion of the second conveyance path 27B in order to suppress or inhibit the developer from entering the first air passage 110 from the outlet 112 and to better direct the airflow from the first air passage 110 to the second air passage 120. In addition, the inlet 121 of the second air passage 120 may be located at the upper portion of the second conveyance path 27B to suppress or inhibit the developer from entering the second air passage 120 from the inlet 121 and to direct the airflow from the first air passage 110 to the second air passage 120.

As illustrated in FIGS. 4 and 5, the developer of the second conveyance path 27B is raised to the downstream side in the rotation direction of the spiral blade 23B by the spiral blade 23B of the second stirring conveying member 23 due to the rotation of the second stirring conveying member 23. Accordingly, as illustrated in FIG. 5, the inlet 121 of the second air passage 120 may be disposed on the downstream side in the air region above the developer, relative to the outlet 112 of the first air passage 110, in the rotation direction of the spiral blade 23B in order to suppress the developer from entering the second air passage 120 from the inlet 121 and to direct the airflow from the first air passage 110 to the second air passage 120. For example, the rotation direction of the spiral blade 23B may be set so that the inlet 121 (of the second air passage 120) is disposed downstream the outlet 112 (of the first air passage 110) in the air region above the developer, in the rotation direction of the spiral blade 23B.

Figure 6:
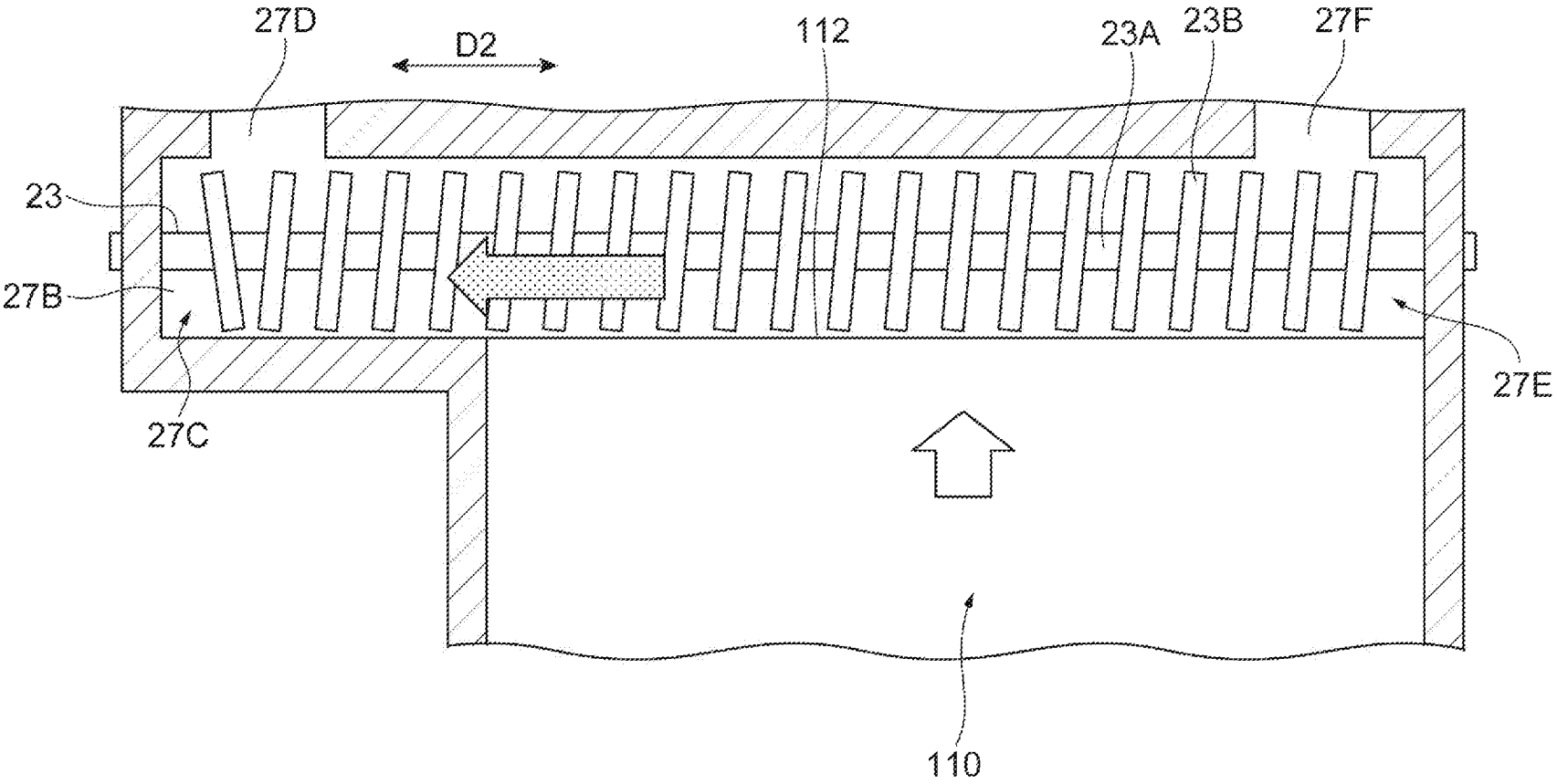
FIG. 6 is a schematic cross-sectional view illustrating a portion of the example developing device including a first air passage and a second conveyance path.
Figure 7:
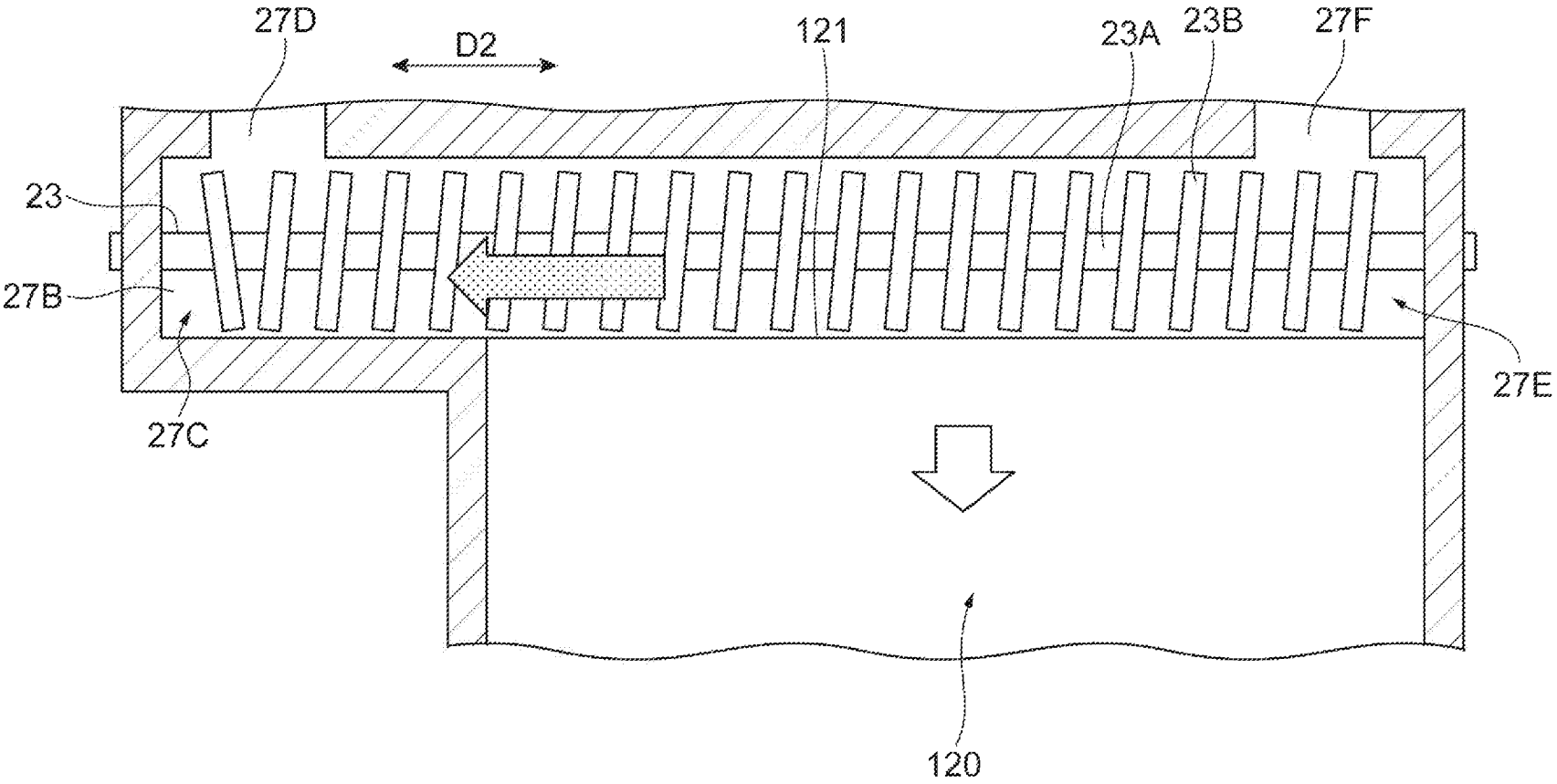
FIG. 7 is a schematic cross-sectional view illustrating a portion of the example developing device including the second conveyance path and the second air passage.

As illustrated in FIG. 3, the developer of the second conveyance path 27B is conveyed from the second opening 27F toward the first opening 27D by the second stirring conveying member 23 and is supplied from the second conveyance path 27B to the first conveyance path 27A through the first opening 27D. Accordingly, the developer may be filled to the upper portion of the second conveyance path 27B at the first end portion 27C of the second conveyance path 27B, that is provided with the first opening 27D. In some examples, with reference to FIG. 6, the outlet 112 of the first air passage 110 may be offset from the first end portion 27C in the longitudinal direction D2, so as not to be coupled directly with the first end portion 27C, in order to suppress or inhibit the developer from entering the first air passage 110 from the outlet 112 and to better direct the airflow from the first air passage 110 to the second air passage 120. In addition, the outlet 112 of the first air passage 110 may be coupled (e.g., fluidly coupled) to the second end portion 27E and may further extend in the longitudinal direction D2 so as to span across the cross-sectional area of the first air passage 110, to thereby reduce the pressure loss of the airflow. In some examples, the first air passage 110 may extend in the longitudinal direction D2 (in parallel to the rotation axis 24A of the developing roller 24). In some examples, with reference to FIG. 7, the inlet 121 of the second air passage 120 may be offset from the first end portion 27C in the longitudinal direction D2, so as not to be coupled directly with the first end portion 27C, in order to suppress or inhibit the developer from entering the second air passage 120 from the inlet 121 and to better direct the airflow from the first air passage 110 to the second air passage 120. In addition, the inlet 121 of the second air passage 120 may be coupled (e.g., fluidly coupled) to the second end portion 27E and extend in the longitudinal direction D2 so as to span across the cross-sectional area of the second air passage 120 and to reduce the pressure loss of the airflow. For example, the second air passage 120 may extend in the longitudinal direction D2 (in parallel to the rotation axis 24A of the developing roller 24).

Accordingly, in the example imaging apparatus 1 including the example developing device 20 illustrated in FIG. 2, a pressure difference is generated between the inlet 111 of the first air passage 110 and the outlet 122 of the second air passage 120 in response to the rotation of the developing roller 24, and consequently, an airflow is generated to flow from the inlet 111 of the first air passage 110 toward the second conveyance path 27B and an airflow is generated to flow from the second conveyance path 27B toward the outlet 122 of the second air passage 120. Accordingly, an increase in pressure of the developing chamber H is suppressed, so as to suppress or inhibit the scattering of the toner in accordance with an increase in pressure of the developing chamber H. Additionally, when pressure in the developing chamber H increases, toner is scattered and discharged from the opening of the housing 21 or along the airflow generated from the developer discharge port of the housing 21.

Further, the developer sucked or drawn into the first air passage 110 is discharged to a region between the developer regulator 25 and the developing region R4, so that the developer is carried on the developing roller 24 and is collected and conveyed back to the developing chamber H, so as to suppress the scattering of the developer discharged from the second air passage 120.

Further, the air passage flowing from the inlet 111 to the outlet 122 is divided into the first air passage 110 and the second air passage 120, in order to simplify the shape of the air passage as compared with a case in which the air passage extending from the inlet 111 to the outlet 122 is configured as a single air passage. For example, the air passage is formed more linearly, by way of the first air passage 110 and the second air passage 120 which both have a substantially linear shape, in order to suppress or inhibit the occurrence of a vortex or the like in the airflow flowing in the air passage, and to further suppress or inhibit an increase in pressure at the developing chamber H by suppressing the first air passage 110 and the second air passage 120 from being narrowed due to the accumulation of the developer.

Further, in the second conveyance path 27B, the cross-sectional area of the air passage extending from the inlet 111 of the first air passage 110 to the outlet 122 of the second air passage 120, increases abruptly. Accordingly, the flow speed of the airflow decreases in the second conveyance path 27B which causes the developer contained in the airflow to fall into the second conveyance path 27B, thereby reducing the amount of the developer accumulated in the second air passage 120.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

Figure 8:
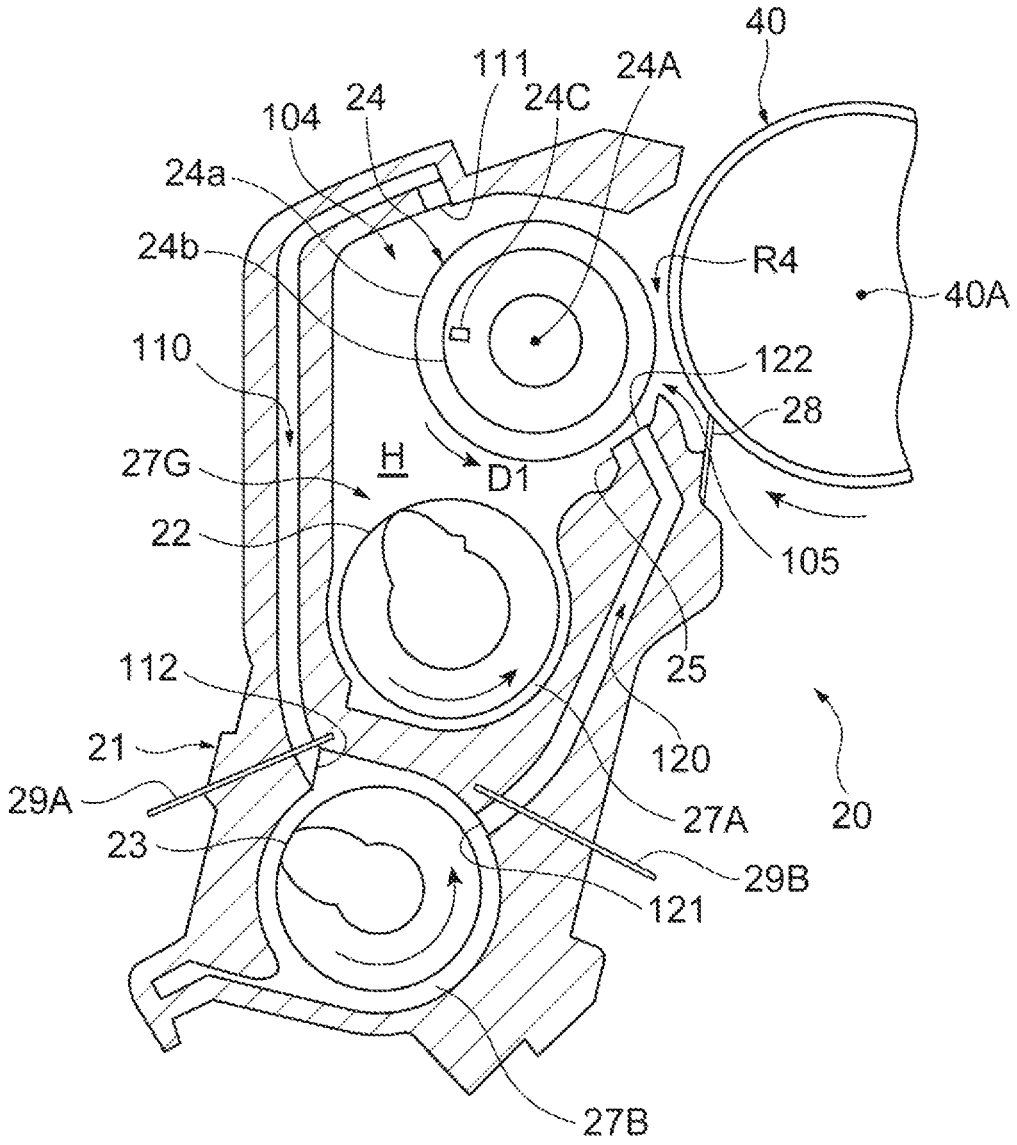
FIG. 8 is a schematic cross-sectional view of an example developing device.

For example, as illustrated in FIG. 8, the developing device 20 may include at least one of a first sealing member 29A that temporarily closes the first air passage 110, and a second sealing member 29B that temporarily closes the second air passage 120. The first sealing member 29A and the second sealing member 29B are detachably attached to the developing device 20. The first sealing member 29A and the second sealing member 29B may be formed in, for example, a thin film shape and can be removed from the outside of the developing device 20. Accordingly, the first sealing member 29A and the second sealing member 29B close the first air passage 110 and the second air passage 120 until the developing device 20 is installed, so as to suppress or inhibit the developer in the developing device 20 (particularly, the second conveyance path 27B) from being discharged from the first air passage 110 and the second air passage 120 to the outside of the developing device 20 when the developing device 20 is turned upside down. Meanwhile, when the first sealing member 29A and the second sealing member 29B are removed from the outside of the developing device 20 after the developing device 20 has been installed, the airflow can flow into the first air passage 110 and the second air passage 120.

Figure 9:
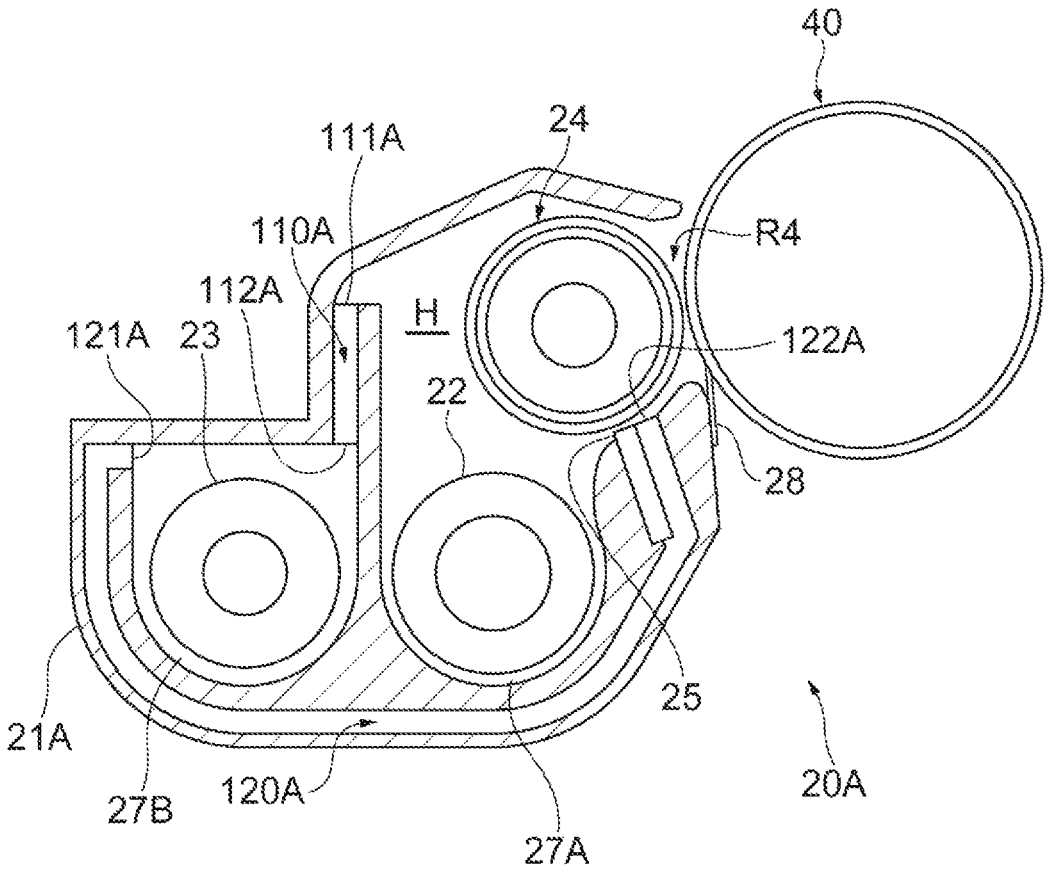
FIG. 9 is a schematic cross-sectional view of an example developing device.

Further, in the developing device 20 illustrated in FIGS. 2 and 3, the first conveyance path 27A and the second conveyance path 27B are arranged in the vertical direction. However, the arrangement relationship of the first conveyance path and the second conveyance path is not particularly limited and the first conveyance path 27A and/or the second conveyance path 27B may be arranged in the horizontal direction similarly to, for example, a configuration in an example developing device 20A illustrated in FIG. 9. The example developing device 20A illustrated in FIG. 9 includes a housing 21A that forms the developing chamber H which accommodates a developing roller 24 or the like, a first conveyance path 27A which accommodates a first stirring conveying member 22, a second conveyance path 27B which accommodates a second stirring conveying member 23, a first air passage 110A, and a second air passage 120A. The first air passage 110A includes an inlet 111A which is coupled (e.g., fluidly coupled) to the developing chamber H on the upstream side in a rotation direction D1 of the developing roller 24 in relation to a developer regulator 25 and an outlet 112A which is coupled (e.g., fluidly coupled) to the second conveyance path 27B. The second air passage 120A includes an inlet 121A which is coupled (e.g., fluidly coupled) to the second conveyance path 27B and an outlet 122A which is coupled (e.g., fluidly coupled) to a region between the developer regulator 25 and the developing region R4.

The example configuration of the developing device 20A suppresses or inhibits an increase in pressure of the developing chamber H by suppressing or inhibiting the first air passage 110A and the second air passage 120A from being narrowed due to the accumulation of the developer, similarly to the developing device 20 illustrated in FIG. 2. Additionally, the example developing device reduces the amount of the developer accumulated in the second air passage 120A by causing the developer contained in the airflow to drop into the second conveyance path 27B.

The invention claimed is:

1. An imaging system comprising:

a housing including a developing chamber, a first conveyance path adjacent the developing chamber, and a second conveyance path adjacent the first conveyance path;

a developing roller located in the developing chamber, the developing roller to rotate in a rotational direction in order to carry a developer to a developing region where the developing roller is closest to an image carrier in order to develop a latent image formed on the image carrier;

a developer regulator located on an upstream side of the developing region in the rotational direction of the developing roller to limit a thickness of the developer carried by the developing roller;

a first stirring-conveying portion disposed in the first conveyance path to supply the developer to the developing roller;

a second stirring-conveying portion disposed in the second conveyance path to circulate the developer between the first conveyance path and the second conveyance path;

a first air passage having an inlet coupled to the developing chamber on an upstream side of the developer regulator in the rotational direction of the developing roller, and an outlet coupled to the second conveyance path; and a second air passage having an inlet coupled to the second conveyance path, and an outlet coupled to a region adjacent the developing roller between the developer regulator and the developing region.

2. The imaging system according to claim 1, wherein the outlet of the first air passage and the inlet of the second air passage are located at an upper portion of the second conveyance path.

3. The imaging system according to claim 2, wherein the second stirring-conveying portion extends along a rotational axis and includes a spiral blade to rotate about the rotational axis, to convey the developer along the second conveyance path, and wherein the inlet of the second air passage is disposed on a downstream side of the outlet of the first air passage in a rotational direction of the spiral blade.

4. The imaging system according to claim 1, wherein the developing roller has a rotational axis extending in a longitudinal direction of the developing roller, wherein the first conveyance path has a length extending in the longitudinal direction, wherein the first conveyance path includes an opening coupled to the developing chamber, and wherein the opening substantially extends along the length of the first conveyance path, and wherein the second conveyance path extends in the longitudinal direction, and wherein the second conveyance path includes a first end portion having a first opening coupled to the first conveyance path, and a second end portion opposite the first end portion that has a second opening coupled to the first conveyance path.

5. The imaging system according to claim 4, wherein the first opening is disposed on a downstream side of the second opening in a conveyance direction of the developer in the second conveyance path, and wherein the inlet of the second air passage is offset from the first end portion in the longitudinal direction.

6. The imaging system according to claim 5, wherein the inlet of the second air passage is coupled to the second end portion and extends in the longitudinal direction.

7. The imaging system according to claim 4, wherein the first opening is disposed on a downstream side of the second opening in a conveyance direction of the developer in the second conveyance path, and wherein the outlet of the first air passage is offset from the first end portion in the longitudinal direction.

8. The imaging system according to claim 7, wherein the outlet of the first air passage is coupled to the second end portion and extends in the longitudinal direction.

9. The imaging system according to claim 1, wherein the developing roller includes a pickoff pole to separate the developer carried on the developing roller from the developing roller, and wherein the inlet of the first air passage is disposed on an upstream side of the pickoff pole in the rotational direction of the developing roller.

10. The imaging system according to claim 1, wherein the first conveyance path and the second conveyance path are arranged relative to one another in a substantially vertical direction.

11. The imaging system according to claim 1, wherein the first conveyance path and the second conveyance path extend in a substantially horizontal direction.

12. An imaging system comprising:

a developing chamber which accommodates a developing roller to carry a developer to a developing region where the developing roller is closest to an image carrier in order to develop a latent image formed on the image carrier, wherein the developer chamber includes a negative pressure region adjacent the developing region, and a positive pressure region located on a side of the developing roller that is opposite to the developing region;

a first conveyance path which accommodates a first stirring-conveying portion located adjacent the developing roller to supply the developer to the developing roller;

a second conveyance path which accommodates a second stirring-conveying portion located adjacent the first conveyance path to circulate the developer between the second conveyance path and the first conveyance path;

a first air passage having an inlet coupled to the developing chamber in the positive pressure region and an outlet coupled to the second conveyance path; and a second air passage having an inlet coupled to the second conveyance path and an outlet coupled to the negative pressure region.

13. The imaging system according to claim 12, wherein the developing roller is rotatable in a rotational direction, and wherein the negative pressure region is formed adjacent the developing roller on an upstream side of the developing region in the rotational direction of the developing roller.

14. The imaging system according to claim 13, comprising:

a developer regulator located adjacent the developing roller on an upstream side of the developing region in the rotational direction of the developing roller, wherein the negative pressure region is formed between the developer regulator and the developing region.

15. The imaging system according to claim 14, wherein the positive pressure region is formed on an upstream side of the developer regulator in the rotational direction of the developing roller.

* * * * *